United States Patent [19]

Zook

[11] 4,293,269

[45] Oct. 6, 1981

[54] CONVERSION OR EXTENSION BEAM

[76] Inventor: Grant W. Zook, 436 Smokepipe Rd., Souderton, Pa. 18964

[21] Appl. No.: 62,167

[22] Filed: Jul. 30, 1979

[51] Int. Cl.[3] ..... B66C 23/44

[52] U.S. Cl. ..... 414/686; 414/607; 414/912; 212/177; 212/266; 37/117.5

[58] Field of Search ..... 414/686, 722–724, 414/591, DIG. 912, 694, 607; 212/177, 237, 238, 266, 260, 261, 271; 37/117.5

[56] References Cited

U.S. PATENT DOCUMENTS

| | | | |
|---|---|---|---|
| 2,621,803 | 12/1952 | Taylor | 212/261 |
| 3,092,259 | 6/1963 | Swanson | 414/724 |
| 3,165,157 | 1/1965 | Carbert | 212/261 X |
| 3,386,594 | 6/1968 | Grove | 212/261 X |
| 3,524,560 | 8/1970 | Hall | 212/177 X |
| 3,527,362 | 9/1970 | Allen | 212/238 |
| 4,159,059 | 6/1979 | Christenson et al. | 414/722 X |

*Primary Examiner*—Robert B. Reeves
*Assistant Examiner*—Terrance L. Siemens
*Attorney, Agent, or Firm*—Raymond Underwood

[57] ABSTRACT

An extension beam is provided to convert a hydraulic excavator to a crane-type hoisting vehicle or to extend the length of a boom.

3 Claims, 7 Drawing Figures

CONVERSION OR EXTENSION BEAM

Figures 1, 2, 3, 4, 5, 6, 7:
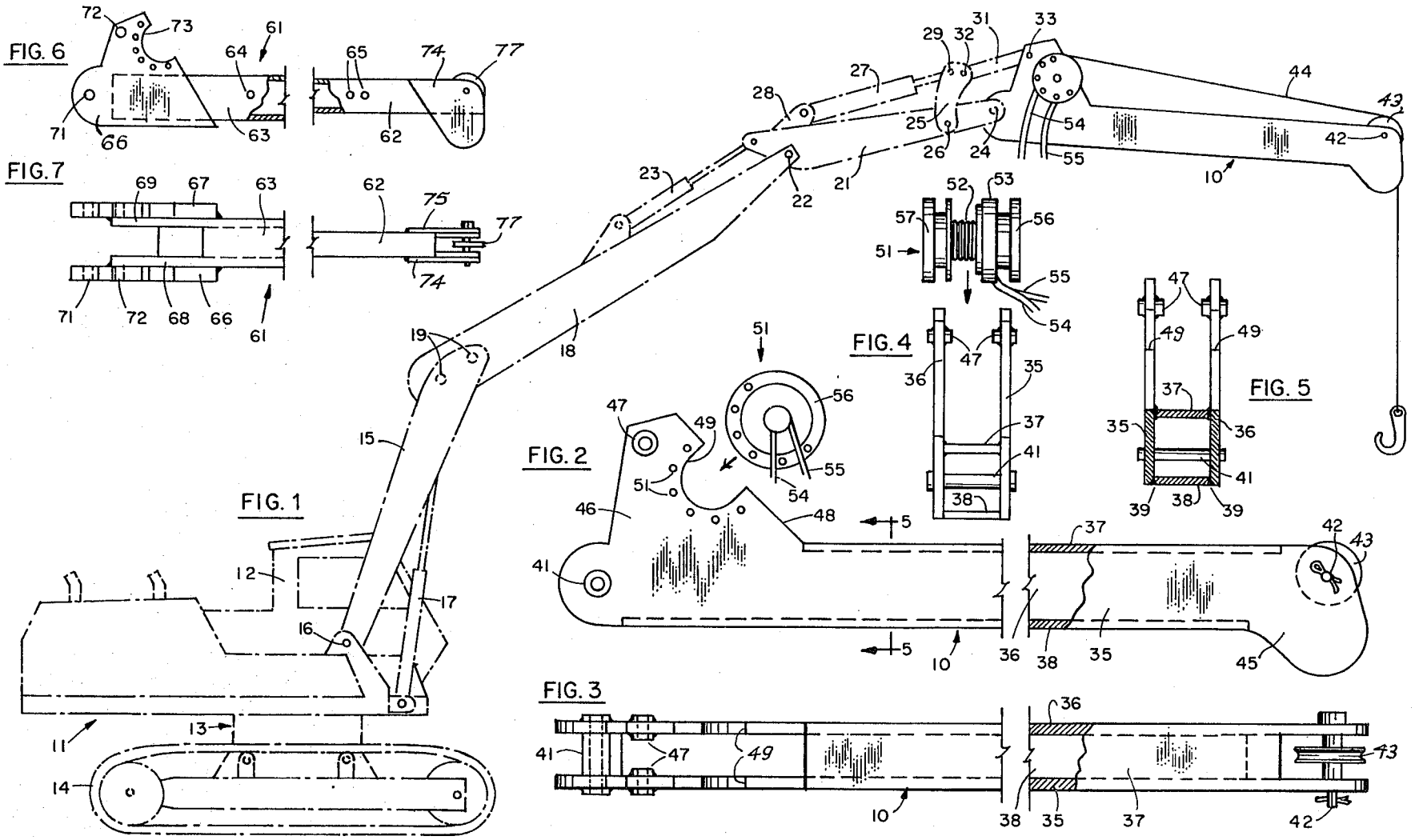

This invention relates to hydraulic excavators and particularly to an extension beam which will replace the usual bucket at the end of the boom. It thus serves to convert a hydraulic excavator to a crane or derrick type vehicle. The beam of this invention can also be added onto the end section of the conventional articulated boom of a hoisting apparatus to increase its reach.

Various constructions of hydraulic excavators are well known in the art. They include a motorized vehicle to which is pivotally attached at least one boom section, the boom section or sections being movable up and down relative to each other by power cables or by hydraulic piston and cylinder arrangements. At the free end of the terminal boom section there is a bucket to dig dirt and like material and transfer it to another area.

The operator on the vehicle has within his reach a number of control levers for making the power operated adjustments required to make full use of the excavator. This includes rotating the entire boom assembly around a vertical axis and adjusting the angular relationship between the boom sections and also involves operating the bucket so it will pick up dirt and then discharge it.

When the hydraulic excavator is the primary machine to be used at a construction site, a need may arise for a conventional mobile derrick or crane which has hoisting apparatus that employs a tackle rigged at the end of the boom. The derrick or crane fills the need for raising, transferring and lowering heavy articles. Obviously, it is expensive to have at a site both a hydraulic excavator and a powered mobile derrick so that both types of work can be carried out. A feature of the invention is that the extension beam to be described may be used to quickly convert a hydraulic excavator to a derrick or crane and quickly reconvert the latter back to a hydraulic excavator.

Another feature of the invention is that the extension beam can be used on a conventional derrick or crane to elongate the boom. Ordinarily, the outward reach of the boom is far enough to perform the intended work and this is made possible by moving the motorized vehicle to a new location. However, some times an obstruction prevents the movement of the vehicle far enough in the desired direction or it would be a waste of time to move the vehicle back and forth slight distances. The extension beam of this invention makes it possible to perform work at a greater distance from the vehicle than would be possible if it were not used.

Beams of this general type are known in the art but they have the disadvantages of being expensive to make and/or lacking the requisite strength. A most serious drawback is that there has been no satisfactory way to attach a winch to the beam to operate a lifting cable which passes over the sheave at the free end of the beam. It is often important that this winch be located on the extension beam because otherwise an extremely long cable would be required to reach back to the vehicle and several guide rollers would be required along the length of the resulting long boom.

In accordance with the invention the structure of the beam makes it possible to attach a conventional hydraulic or electric winch to the beam. Moreover, this attachment is a strong, rigid one which firmly prevents dislodgment of the winch from the beam. The attachment and removal of the winch to and from the extension beam can be accomplished in a short time as an important feature of the invention is that the winch rests in a seat or resting base on the beam and this makes it easy to apply and remove the holding bolts.

Representative embodiments of the invention are illustrated in the accompanying drawings, in which:

FIG. 1 is a side view of a hydraulic excavator from which the usual bucket at the outer end of the boom has been removed and been replaced by the preferred structure of the extension beam of the invention, FIG. 2 is a side elevation of this extension beam with the winch displaced, FIG. 3 is a plan view of the beam of FIG. 2, FIG. 4 is a view of the left hand end of FIG. 2, FIG. 5 is a section on the line 5—5 of FIG. 2, FIG. 6 is a side elevation of an extension beam with several modifications incorporated in it and FIG. 7 is a plan view of FIG. 6.

In FIG. 1 the extension beam of this invention is indicated at 10 and it will be noted that it is the outermost section of the boom. The remainder of the boom and the vehicle to which it is attached is representative of a commercial, conventional hydraulic excavator and therefore need not be described in detail. The mobile vehicle indicated at 11 includes the upper body 12 with the cab and engine, which is supported on the pedestal 13 of the lower frame which has the caterpillar tread 14 or equivalent wheels. The upper body 12 can, of course, pivot around the vertical axis provided by the pedestal 13 of the lower frame.

The first boom section 15 is pivotally attached to the upper body 12 at the horizontal pins or bearings 16. This boom section is moved up and down about this pivot by the hydraulic cylinder 17; its hose connections to the manual controls in the main body 12 are not shown as they are well known in the art. The second boom section 18 is generally permanently affixed by the bolts 19 to the first boom section 15 but this can, of course, be a pivotal connection under the control of a separate hydraulic cylinder.

The third boom section 21 is pivotally attached at 22 to the outer end of the second boom section 18 and these boom sections are moved relative to each other by the hydraulic cylinder 23. At the outer end of the third section 21 is a transverse bearing (not shown) to receive the bearing pin 24; a digging bucket is ordinarily attached by means of this pin 24. As will be explained, this same pin 24 is used to attach the extension beam 10 of this invention to the third boom section 21.

An arm 25 is pivotally attached to the boom section 21 by means of the transverse pin 26 and there usually is a like corresponding arm (not shown) on the opposite side of the boom section 21. To oscillate the arm (or arms) 25 about pivot 26 the hydraulic cylinder 27 is provided and its base end is pivotally attached to the upstanding bracket 28 on the section 21. Its piston rod is pivotally attached at 29 to the arm or arms 25. A connecting link 31 is also pivotally connected at pin 32 to the arm 25.

The structural parts described so far, with the exception of the extension beam 10, are conventional in commercial hydraulic excavators and are intended to be representative of the mechanical variations which accomplish the same functional purposes in the products of different manufacturers. A, for instance, conventional digging bucket (not shown) is attached by the pivot at 24 to the outer end of the third section 21 and the bucket may be swung about this pivot 24 by its attachment by the pin 33 to the outer end of the link 31. The imposition of the arm 25 into this connection to the power cylinder 27 is to accomplish a bell-crank lever effect when the bucket is in a depending position.

The extension beam 10 is made up of the elongated, identical side plates 35 and 36, the top plate 37 and the bottom plate 38. They are welded together along their lengths at 39, see FIG. 5, so that in cross section a generally box-like, square formation results. This provides an unusually strong but relatively light weight construction to resist bending and twisting under stress.

At one end of the side plates 35 and 36 there are axially aligned, transverse holes to receive the crosswise bearing pipe or tube 41 and this bearing pipe is welded to both side plates. This bearing pipe 41 is parallel to the bottom plate 38 and is at right angles to the length of the beam. The bearing pipe 41 serves the double purpose of strengthening the attached ends of the side plates 35 and 36 and serving as a bearing to receive the pivot pin 24. This assembly at the end of the beam 10 provides a strong construction and it fits between the side plates of the third section 21.

At the other end of the beam 10 the side plates 35 and 36 have aligned holes to receive the sheave pin 42. The sheave 43 is rotatably mounted on this pin 42 and the cable 44 passes over it. To make sure that the cable remains on the sheave the side plates 35 and 36 are formed with a downwardly extending lobe 45. These depending lobes may be omitted but if they are present they tend to keep the cable on the pulley if the cable is being used to drag an article sidewise.

Both side plates 35 and 36 have the upward extensions 46 which are located close to the ends having the cross pipe 41 between them. At the top, rearward part of the upward extensions are aligned holes in each of which a bushing 47 is welded. They receive the pin 33 so that actuation of the link 31 will move the free end of the beam 10 up and down. It should be noted that the pins 24, 33 and 42 are parallel to each other.

The front edge 48 of the upward extension 46 slopes forwardly and downwardly relative to the length of the beam so that this edge makes a 135° angle, more or less, with the top edge of the side plate. In this face 48 is a depression or notch 49 which is here shown as of circular contour. These notches 49 in both side plates are to form seats for and to receive the power winch which is generally indicated by the numeral 51. This winch is a standard, commercial product.

This winch has the usual winding drum 52 with its cable, the hydraulic power motor 53 with its hydraulic hose 54 and 55, (an electrical winch can be substituted) and the two attachment discs or flanges 56 and 57. These flanges have bolt holes through them and they are to line up with corresponding bolt holes 51 around the seating notches 49 so that fastening bolts may be attached. It should be noted that the attachment flanges 56 and 57 are so spaced that they lie flat against the outsides of the side plates 35 and 36 respectively.

The slope of the edges 48 and the fact that the notches 49 extend generally perpendicularly inwardly and therefore downwardly makes it easy to locate the winch in its proper place. This is because the notches 49 have a bottom edge which forms a seat for the winch to rest on and be held in place while the holding bolts are being applied. The winch cannot fall out of the notches and the winch does not have to be manually held while the bolts are being put in or taken out.

Before attaching the extension beam 10, the boom would first be lowered to the ground and the pins 24 and 33 would be removed from the digging bucket so that it would come off of the boom. Then, with the extension beam 10 lying on the ground, it is brought to the proper position so that the pivot pin 24 and the connecting pin 33 can be replaced to tie the beam 10 to the end of the boom. The winch 51 may have previously been fastened in place or it may now be fastened in its seat. Then the hydraulic hose 54 and 55 will be connected to the supply and return hose leading to the operator. In this manner the hydraulic excavator has been converted to a derrick or crane.

The beam 61 of FIGS. 6 and 7 includes several distinct variations or modifications of the extension beam and one or more of them may be incorporated into the extension beam 10. Or, the entire structure of FIGS. 6 and 7 may be substituted for the beam 10 so that the beam 61 is used as a unit.

The beam 61 is made telescopic so that it can readily be elongated or shortened. This is accomplished because the outer section 62 is of smaller cross section so that it will snugly fit within the base portion 63. Both portions 62 and 63 are fabricated out of plates as explained above for beam 10 but the outer portion is smaller so it will slide back and forth in the larger base portion 63. The two portions are held in the desired relationship by a bolt or pin (not shown) passing through the holes 64 and 65.

Another variation in the beam 61 is that the large attachment plates 66 and 67 of the base section 63 are welded to the outsides of the side plates 68 and 69. These attachment plates may be of thicker steel than the steel of the remainder of the beam 61 with the result that the cross pipe bearing may be eliminated. Also the holes 72 for pin 33 do not need to be reinforced with bushings.

The elimination of the pipe bearing at 71 makes it possible to locate the attachment plates 66 and 67 on the outside of the third boom section 21 instead of inside of its side plates. Instead of the integral lobes 45 of FIG. 2, the beam 61 has outer plates 74 and 75 welded at the outer end of the smaller portion 62.

The notches 73 of the attachment plates 66 and 67 provide seats for the winch as is explained above. This winch may be hydraulic or electrically operated as mentioned above. The winch can rest in these notches 73 as they serve as pockets to hold the winch while its fastening bolts are being applied. The sheave 77 is supported on a bearing pin at the outermost end of beam 61.

From the above it is apparent that the formation of the side plates with the upward extension 46 is one of the important features of the invention. It provides the forward sloping edge in which the seat notches 49 are formed. Also it provides a leverage action about the pivot pin at 41 as the bearing at 47, which may be called a motive bearing, is located in this upward extension. The beam of the invention may, of course, be a permanent part of a boom of a hoisting crane or derrick.

I claim:

1. An extension beam for replacement of the scoop bucket of a hydraulic excavator to convert it from a power shovel operation to a power hoist operation, comprising two spaced side plates joined along their lengths by a top plate and a bottom plate which together form an elongated beam which is box-like in cross section, the side plates having aligned sheave bearings at one end for receiving a transverse sheave supporting pin, the other ends of the side plates having aligned pivot bearings for receiving a transverse pivot pin about which the beam swings up and down, and said side plates having upward extensions above said pivot bearings through the top portions of which are aligned motive bearings for receiving a transverse pin of a driving linkage, said sheave bearings, pivot bearings and motive bearings being parallel to each other and at right angles to the length of the beam, the upper edges of said upward extensions sloping downwardly and forwardly toward said sheave bearings and having notches therein to form seats to receive a winch.

2. The extension beam of claim 1 in which the beam is made up of end-to-end portions which are telescopic relative to each other.

3. The extension beam of claim 1 in which said notches extend inwardly perpendicularly to said upper edges to thereby form pockets in the upward extensions.

* * * * *